United States Patent [19]

Sheng

[11] Patent Number: 4,867,724

[45] Date of Patent: Sep. 19, 1989

[54] RISE AND FALL TYPE BUBBLE BLOWER

[76] Inventor: Lin Mong Sheng, No. 195, Chieng-Kou Rd., Hsintien, Shih, Taipei, Hsien, Taiwan

[21] Appl. No.: 110,679

[22] Filed: Oct. 19, 1987

[51] Int. Cl.[4] ..... A63H 33/28

[52] U.S. Cl. ..... 446/17; 446/15; 446/19

[58] Field of Search ..... 446/15, 16, 17, 18, 446/19, 20, 21

[56] References Cited

U.S. PATENT DOCUMENTS

| | | | |
|---|---|---|---|
| 2,675,641 | 4/1954 | Baggott | 446/18 |
| 3,736,694 | 6/1973 | Lebensfeld | 446/16 |
| 3,845,583 | 11/1974 | Ziff | 446/17 |

FOREIGN PATENT DOCUMENTS

| | | | |
|---|---|---|---|
| 1207292 | 9/1970 | United Kingdom | 446/15 |

*Primary Examiner*—Robert A. Hafer
*Assistant Examiner*—Sam Rimell
*Attorney, Agent, or Firm*—Lowe, Price, LeBlanc, Becker & Shur

[57] ABSTRACT

A rise and fall type bubble blower toy is described. The device consists of a cylinder having a diaphragm across the central portion thereof with an axial port and having a nozzle mounted on the upper surface of the diaphragm. A piston is disposed below the diaphragm and mounts upstanding rods which support a ring which rests on the upper surface of the cylinder and which in turn supports an inner ring which is normally disposed within the cylinder above the nozzle. An air inlet to the cylinder is provided below the piston. The cylinder is mounted within a housing which may have any desired configuration disposed below the diaphragm and mounts upstanding rods which support a ring which rests on the upper surface of the cylinder and which in turn supports an inner ring which is normally disposed within the cylinder above the nozzle. An air inlet to the cylinder is provided below the piston. The cylinder is mounted within a housing which may have any desired configuration and which includes a blow pipe and a passage placing the blowpipe in communication through the inlet i the bottom of the cylinder with the interior of the cylinder below the piston. When a soap solution is disposed within the reservoir formed by the diaphragm, nozzle, and upper portion of the cylinder the inner ring normally is submerged. When air is admitted through the blowpipe to the cylinder the piston will be driven upwardly which will cause the ring to move out of the solution above and be disposed above the nozzle. When the piston reaches its zenith internal ports are uncovered so that the air from below the piston is admitted to the nozzle for blowing bubbles.

1 Claim, 3 Drawing Sheets

RISE AND FALL TYPE BUBBLE BLOWER

FIELD OF THE INVENTION

This invention elates to a bubble blower toy and in particular to an air pipe which may be configured externally in any desired toy type shape. The device of this invention uses a piston activated by air to the air pipe to blow bubbles.

SUMMARY OF THE INVENTION

The model of this invention is a cylindrical shape bubble blower toy. It has a "fluid holding cup" fixed to it. At the center of this cylinder is an air exit tube protrusion. The mouth of the pipe is higher than the bottom part of the fluid cup so as to prevent the fluid from flowing back into the cylinder in reverse direction. A fluid immersion ring is connected with the piston to allow for its simultaneous movement with the piston. When air is introduced into the cylinder, the piston rises up, as this happens, the fluid immersion ring also rises up above the air exit tube. At a point when the piston reaches its zenith, perforated holes in the air exit pipe are exposed, air rushes into the air exit via the perforated holes and towards the fluid immersion hole in which the fluid film is located. There, with the air continuously supplied, the bubble is produced again and again. If the pressure of the air decreases, the piston will drop back into the bottom part of the cylinder, the fluid immersion ring also drops into the cup and bubbles cease.

DETAILED DESCRIPTION OF THE PREFERRED EMBODIMENT

Figure 3:
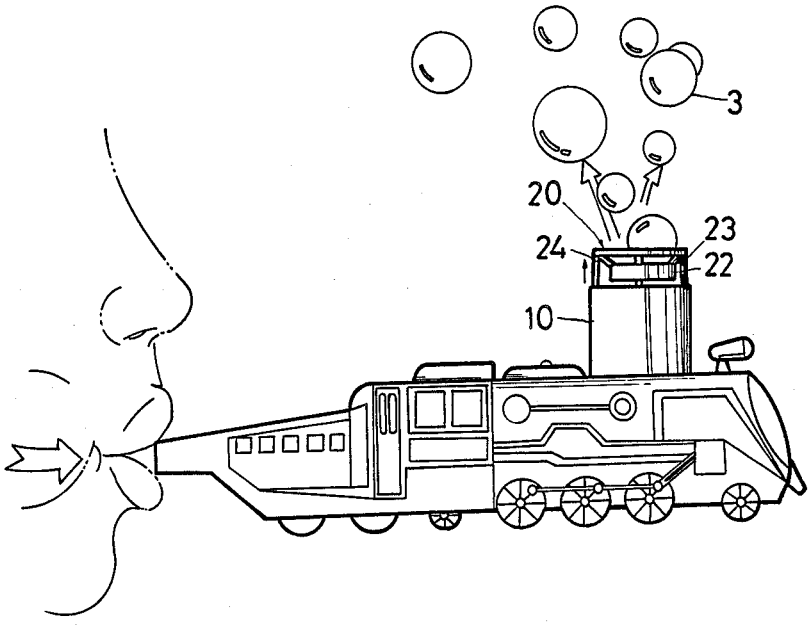
FIG. 3 is a side view of the embodiment of FIG. 2.

The embodiment of the bubble blowing toy described in this case is a locomotive toy. This is the shape of the outer part of this invention as shown in FIG. 3. The main component parts are the body (10), a blow pipe (19) and a ring seat (20) which can rise and fall with the support of rods (23). If soap fluid is poured into the fluid cup (15) and air gently blow into the cylinder (13) from the blow pipe (19), the ring seat (20), rises, forming fluid films at 22. As this happens, bubbles 83) are continuously produced at the center of the cup.

Figure 1:
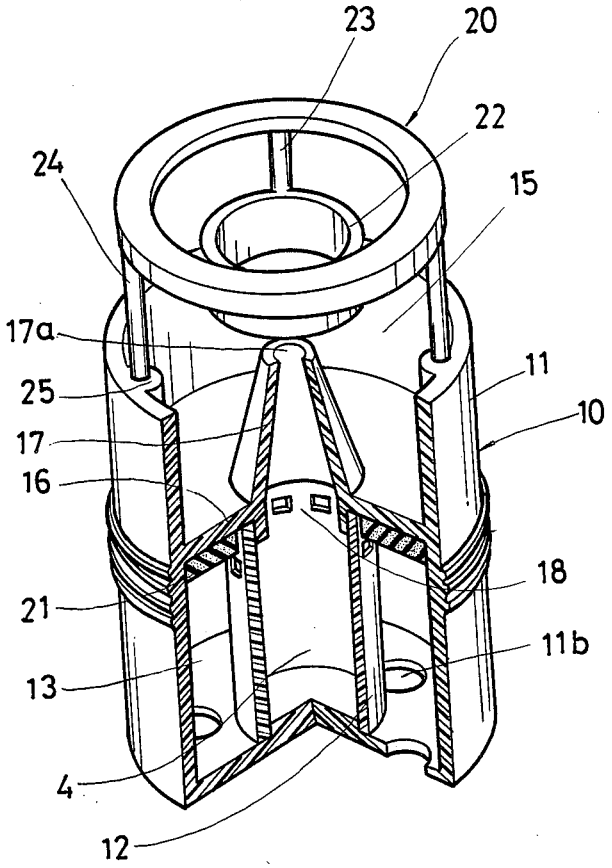
FIG. 1 is a perspective view of the piston of this invention in partial section.
Figure 2:
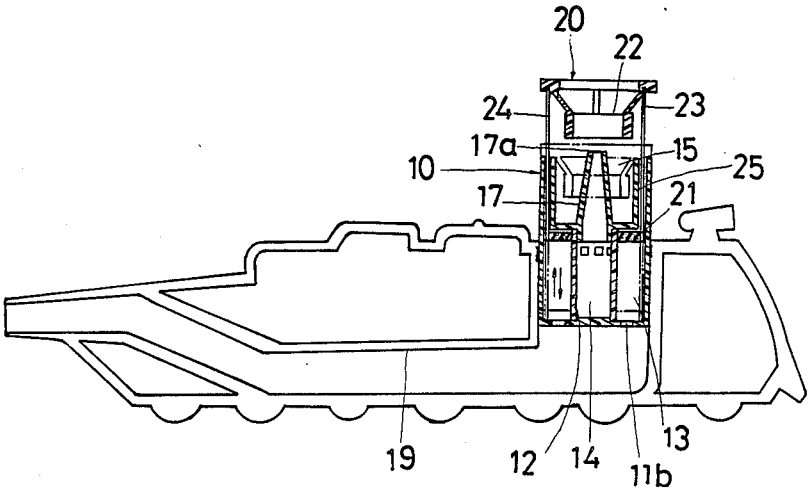
FIG. 2 is a longitudinal cross section of an embodiment of this invention.

FIG. 2 is an example incorporating the component of FIG. 1 of this invention. It is a longitudinal cross section of the invention. The cup body (10) of this bubble blower is made of two layers, the inner layer or inner cup (12) and the outer layer or outer cup (11). These two cups are assembled together with a uniform space between them which serves as a cylinder (13) for the piston (21). The inner cup (12) has an upper and lower parts. The lower part is regarded as air chamber (4). The ventilation holes (18) are provided in the upper part of the air chamber (4). The center of the fluid body (10) is blocked with a diaphragm (16). The diaphragm (16) forms a central ventilation pipe or nozzle (17) which extends upwardly through the fluid cap (15).

The upper part of the inner cup (12) forms the soap fluid container or cup (15). At the top of the cup is an "M" shaped structure called the ring seat (20) which enables the fluid film to be formed. The recessed part of the ring has an opening (22). Support rods (24) at the outer part of the ring (20) are linked to the piston (21).

These supporting rods slide upwards and downwards along the guide pipes (25). The piston (21) extends between the inner cup (12) and the outer cup (11). Air from the blow pipe (19) then pushes the piston (21) upwardly in cylinder (13).

FIG. 3 shows an embodiment of this invention in use. At first, the soap fluid is poured into the fluid cup (15) to immerse the ring opening (22) of the ring seat (20). As air is blown into the system through the pipe (19), it travels via ports (11*b*) into cylinder (13) pushing the piston upwards. When the piston rises upwards due to air pressure, the ventilation holes (18) are exposed allowing air to rush into the air chamber (4) of the inner cup (12). The ring seat also rises as the piston rises, forming the fluid film. Air exiting through the nozzle end (17*a*) touches the fluid film, causing it to produce bubbles.

As mentioned, the ring seat (20) naturally returns to its original place if the pressure of the air is reduced. It will rise if air is introduced again through the pipe (19). Air also pushes the piston (21) up causing the ring seat to make consecutive rising and falling movements which create the fluid films that makes bubbles possible.

This rise and fall type bubble blower is not only suitable with a locomotive shape but also could take the shapes of a leopard and a saxophone. The different shapes of bubble blowers are interesting to children and arouses their curiosity and enthusiam for fun and happiness which is the motive and main objective of this invention.

What is claimed is:

1. A rise and fall type bubble blower comprising:

a housing having a predetermined external configuration and defining a blow pipe air inlet and an upwardly opening outlet port;

a cylinder disposed at least in part within the outlet port said cylinder having an internal air inlet at the bottom thereof in communication with the blow pipe inlet;

a diaphragm extending across the internal central portion of said cylinder and having an axial port therein, a nozzle mounted on the upper surface of said diaphragm, said nozzle, the upper surface of said diaphragm and the upper portion of said cylinder above said diaphragm defining a reservoir;

a cylindrical chamber mounted coaxially within said cylinder extending downwardly from the lower surface of said diaphragm and surrounding the axial port therein;

said chamber having a closed lower end and at least one circumferential port adjacent said diaphragm;

an annular piston slidably disposed within said cylinder surrounding said chamber and movable between the inlet in the bottom of said cylinder and the lower surface of said diaphragm, said piston adapted to place the interior of said chamber in communication with the air inlet in the bottom of said cylinder only when it is disposed abutting the lower surface of said diaphragm; and a bubble ring normally disposed within the reservoir surrounding said nozzle and means connecting said piston and ring for raising and lowering said ring responsive to movement of said piston whereby when said piston is at the bottom of said cylinder said ring will be disposed in the reservoir but when air is admitted causing said piston to rise said ring will rise above said nozzle so that when air from said cylinder is admitted to said chamber and expelled from the nozzle it will be directed through said ring.

* * * * *